US005829623A

United States Patent [19]

Otsuka et al.

[11] Patent Number: 5,829,623

[45] Date of Patent: Nov. 3, 1998

[54] EASILY OPENABLE CAN LID

[75] Inventors: Hideo Otsuka; Hiroyuki Terasawa, both of Tokyo; Shigeaki Yamanashi, Kanagawa; Ichio Otsuka, Kanagawa; Sunao Morishita, Osaka, all of Japan

[73] Assignee: Toyo Seikan Kaisha, Ltd., Tokyo, Japan

[21] Appl. No.: 156,764

[22] Filed: Nov. 24, 1993

[30] Foreign Application Priority Data

Dec. 8, 1992 [JP] Japan ..... 4-358075

[51] Int. Cl.[6] ..... B65D 8/08; B65D 17/34

[52] U.S. Cl. ..... 220/269; 220/906

[58] Field of Search ..... 220/269, 270, 220/272, 273, 623, 624, 608, 609, 906, 907, 89.1, 263

[56] References Cited

U.S. PATENT DOCUMENTS

| | | | |
|---|---|---|---|
| 3,401,822 | 9/1968 | Fraze | 220/273 |
| 3,404,800 | 10/1968 | Arfert | 220/269 |
| 3,441,170 | 4/1969 | Khoury | 220/273 |
| 3,525,455 | 8/1970 | Saunders | 220/624 X |
| 3,743,129 | 7/1973 | Willis et al. | 220/269 X |
| 3,774,801 | 11/1973 | Gedde | 220/623 |
| 3,874,553 | 4/1975 | Schultz et al. | 220/273 |
| 4,093,102 | 6/1978 | Kraska | 220/263 |
| 4,372,462 | 2/1983 | Dassler et al. | 220/269 |
| 4,394,927 | 7/1983 | Zysset | 220/273 |
| 4,577,774 | 3/1986 | Nguyen | 220/623 |
| 4,796,772 | 1/1989 | Nguyen . | |

FOREIGN PATENT DOCUMENTS

| | | |
|---|---|---|
| 88968 | 9/1983 | European Pat. Off. . |
| 5-69066 | 3/1993 | Japan . |
| 5-112357 | 5/1993 | Japan . |

OTHER PUBLICATIONS

Important Information on JP 5112357 prepared via Dialog on JP & JAPIO, May 1993.

*Primary Examiner*—Allan N. Shoap
*Assistant Examiner*—Nathan Newhouse
*Attorney, Agent, or Firm*—Foley & Lardner

[57] ABSTRACT

An easily openable can lid wherein buckling parts are provided nearby a peripheral groove formed on the can lid in a range of 25 to 65 degrees from the center of the top plate from a line between the tip end of the openable member and the center of the top plate in all sector segments formed when the can lid is divided into four sector segments by a line between an extreme end of the openable member and the center of the top plate and a line which passes through the center of the top plate and orthogonally intersects the above described line. A reinforcing part with a reinforcing effect smaller than a buckling effect is provided at a coupling part between the top plate and the peripheral groove or near said coupling part except for the buckling part at an opposite side of the openable member and its neighborhood to provide a difference of strength between the buckling part at the openable member side and the buckling part at an opposite side of the openable member.

31 Claims, 4 Drawing Sheets

EASILY OPENABLE CAN LID

BACKGROUND OF THE INVENTION

The present invention relates to a push-open type easily openable can lid for which the stability in storage is improved.

Generally, the can lid of an easily openable container is often provided with a tab called an "pull-open type". However, most pull-open type openable members which form the opening part can be separated from the can lid top plate and therefore there have been various problems caused by openable members that are inadvertently lost. These end parts of the openable members have caused hands and feet to be hurt since the end part of the openable member is relatively sharp. Also accidents have occurred with fish and birds which have died due to ingestion of discarded openable members. For this reason, can lids each being provided with a type of openable member having a connecting part with the top plate of the can to prevent the openable member from being completely separated from the can lid top plate have been proposed.

In the case of cans having a coupling part for coupling the pull-open type openable member and the can lid, when a person directly drinks a beverage from a can container such as beverage can containers, the openable member is positioned immediately in front of his nose and the drinker cannot avoid a sense of incompatibility due to the openable member being nearby his nose. Therefore this type of can container is disadvantageous in that most consumers do not like this type of can. A can lid of an easily openable container which is improved so that the openable member cannot be completely removed from the top plate of the container is referred to as the "push-open type" with the openable member capable of being pushed down into the container.

Though the above described disadvantage of the openable member of these push-open type can lids is eliminated, a new problem occurs in practical use.

Most liquid beverages contain gas such as carbon dioxide gas. When the internal pressure of these beverage containers which contain a beverage containing a gas rises during storage, the containers are pushed up from inside to often cause a buckling phenomenon; that is, the can lids are pushed outwardly from the inside and partly bulged. Therefore, the opening score line is ruptured resulting in opening of the can lid and beverage contained therein splashes out.

This phenomenon often occurs on push-open type can lids.

An invention which has solved this problem is disclosed in the Japanese Patent Application No. 3-307253/1991. This disclosure specifies a can lid on which a thin wall reinforcing part is arranged by coining a part nearby the peripheral groove of the top plate except for the extreme end of the openable member surrounded by the score line. A weak-to-pressure part such as an embossed concavity or a coining groove is provided at the peripheral groove of the top plate except for a part around the extreme end of the openable member. The device of the above Japanese Patent Application disclosure is highly effective in thick wall can lids and the above described problem can be resolved.

However, if the buckling occurs a plural number of times on can lids that are 0.285 mm or less in thickness, the can lids bulge and appear wholly arc-shaped. A problem, which particularly occurs in cases of thin can lids, is that a second buckling tends to occur at an opposite position, in reference to the center of the lid, from where the first buckling has been caused. Accordingly, the second buckling may occur at the extreme end of the openable member in cases of the above described thin can lids.

An invention which is intended to prevent rupture of the score line by making the buckling occur in the predetermined positions and order by controlling the positions is disclosed in the Japanese Patent Application No. 3-333819/1991. This disclosure specifies providing a buckling part on two sector segments of the can lid at the opposite side of the openable member of the can lid which is divided into four sector segments by a line between the extreme end of the openable member and the rivet and a line which orthogonally intersects this line at the rivet whereby the buckling is caused to occur.

Though this prior development is fully effective for controlling the position of the first buckling, the positions of the second and following buckling cannot be fully controlled only with two weakened portions, and buckling had been caused, in some cases, at a position near to the extreme end of the openable member.

SUMMARY OF THE INVENTION

The object of the present invention is to make the buckling occur in a predetermined order by controlling the positions of first, second and following bucklings the control of which has been impossible heretofore and to prevent rupture of the score line by preventing the buckling at a position near the extreme end of the openable member. The present invention had succeeded in solving the subject with special means.

In attaining the above and other objects, one feature of the present invention resides in an easily openable can lid having a top plate and a peripheral groove provided at a periphery of the top plate. A tab is fastened to the top plate at an approximate center of the top plate with a rivet, and a score line with starting and ending points is located beside said rivet with a distance serving as a hinge. An openable member is surrounded by the score line, wherein a buckling part is provided near to the peripheral groove in a range of 25 to 65 degrees from the center of the top plate from a line between the tip end of the openable member and the center of the top plate in all sector segments formed when said can lid is divided into four sector segments by a line between an extreme end of said openable member and the center of said top plate and a line which passes through the center of the top plate and orthogonally intersects the above described line. A reinforcing part with a reinforcing effect smaller than a buckling effect is provided at a coupling part between the top plate and the peripheral groove or near said coupling part except for the buckling part at an opposite side of said openable member and its neighborhood to provide a difference of strength between the buckling part at the openable member side and the buckling part at an opposite side of the openable member.

In a more detailed aspect, a buckling part with a smaller buckling effect than that of a buckling part provided respectively on two sector segments at an opposite side of said openable member is provided respectively on two sector segments at a side where said openable member is provided. The buckling part is formed concaved on the top plate by coining or scoring as viewed from the machining side. It can also be formed concave by embossing as viewed from the machining side. The buckling part can be a dimple formed on the top plate by pushing up said top plate. In addition, the buckling part can be a deformed internal wall part which is formed by deforming an internal wall of said peripheral groove toward the center of the top plate.

The buckling part is at an extreme end of a bead formed on the top plate by beading. The beading can be linear or arc-shaped. Preferably, the buckling part is an extreme end of an arc-shaped bead provided along nearby the peripheral groove of the top plate.

In a more detailed aspect, the buckling part is an extreme end of a bead provided across each of two sector segments at the opposite side of the openable member and each of two sector segments at the openable member side.

An end of the buckling part is arranged within a range of 25 to 65 degrees from the center of the top plate from a line between an extreme end of an openable member of a concentric annular part along the peripheral groove of approximately 12 mm in width toward the center of the top plate from a position of an external wall of the peripheral groove approximately as high as the top plate and the center of the top plate and the other end of said buckling part is an extreme end of each of four linear or arc-shaped beads located at the center said of the top plate from this range and arranged in all sector segments.

In more detail, when the buckling part is an extreme end of an arc-shaped bead, the extreme end of said arc-shaped bead is arranged across each of two sector segments at the opposite side of the openable member and each of two sector segments at the openable member side and said arc-shaped bead being formed as convexed at the center side of the can lid.

According to the invention, the buckling part is provided by using one or combining two or more of coining, scoring, embossing, dimpling, deforming of the internal wall, and beading procedures.

In a detailed feature, the buckling part is a composite buckling part formed by doubly applying two or more processes of coining, scoring, embossing, dimpling, deforming of the internal wall, and beading.

The reinforcing part in general is a panel coining part formed by coining the overall periphery of the coupling part between the top plate and the peripheral groove except for the buckling part at the opposite side of the openable member. The reinforcing part can be overlapped or not overlapped with the buckling part at the openable member side.

In still more detail, the reinforcing part is a deformed coupling part with a smaller radius of curvature of the coupling part between the top plate and the peripheral groove along the overall periphery except for the buckling part at the opposite side of the openable member than the radius of curvature of a peripheral part nearby the buckling part at the opposite side of the openable member.

Also the reinforcing part can be a deep groove with a larger depth of the top plate and the top plate and the peripheral groove along the overall periphery except for the buckling part at the opposite side of the openable member than a depth of a peripheral groove near the buckling part at the opposite side of the openable member.

BRIEF DESCRIPTION OF THE DRAWINGS

The invention will be further understood with reference to the drawings, wherein.

PREFERRED EMBODIMENTS OF THE INVENTION

Figure 1:
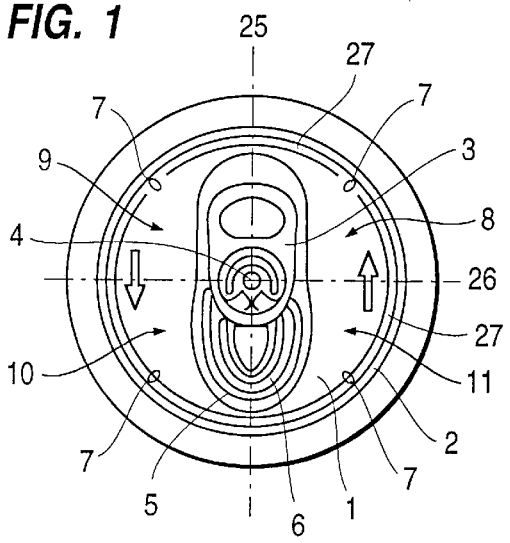
FIG. 1 is a plan view of a can lid according to the present invention.

Though a push-open type can lid from which the openable member is not removed is desirable, as described above, since it is free from a problem due to a separated openable member, it is disadvantageous in that the score line can be ruptured by buckling due to an internal temperature rise of a can during storage.

As a result of studies on the causes of this problem, the inventor of the present invention clarified that the rupture of the score line would be caused only on the push-open type can lid due to a difference of the depth of the opening score line between the pull-open type can lid and the push-open type can lid. It was also clarified that an amount of bulging of the can lid of a thin wall due to buckling is large and therefore rupture of the score line will occur.

In the case of the conventional pull-open type can lid, the openable member can be opened by pulling it with the pull tab even though the score line for removing the openable member is shallow at the periphery of the top plate and the remaining thickness of the scored part is large; however, in the case of a push-open type can lid, the remaining thickness of the scored part need be small since the score line is ruptured by pushing down the openable member inside the can with the tip end of the tab. In particular, the periphery of the top plate at the extreme end of the openable member or, in other words, the tap part is away from the tab and a force can hardly be applied to this tap part and therefore the remaining thickness of the scored part should be small.

The remaining thickness of the scored part is small at a portion of the openable member near the periphery of the top plate as described above and therefore the score line is ruptured when the buckling occurs at this portion.

Buckling occurs because the internal temperature of the can rises and the internal pressure of the can also increases to push up the can lid from inside when it is placed in a high temperature environment such as in an automobile. The can lid is provided with a groove at the periphery of the top plate and a tightening part is provided outside this peripheral groove. If the groove is press-formed, a residual stress occurs at this groove to cause the internal pressure of the can to be increased and this groove is outwardly bulged to form a convexity. This is the phenomenon called "buckling".

Gas contained in a beverage is 1.5 to 4.5 times as much as the volume of beverage and therefore the bulged part of the can is filled with gas in accordance with the condition for storage even after the buckling has occurred once and, when the internal pressure rises, the buckling is caused repeatedly.

Taking into account the difficulty in complete prevention of the buckling in the case of the push-open type can lid, the inventor of the present invention studied the cause of the buckling at a portion other than the opening score, particularly, the score at the extreme end of the openable member near the periphery of the top plate. Accordingly, the risk of rupture of the score line can be eliminated even though the buckling occurs at the above described position.

Therefore, according to the invention, a buckling part is formed at a position free from the risk of rupture of the score line of the can lid where a buckling with small pressure resistance is apt to occur.

Second and third buckling may be caused repeatedly and the deformation due to buckling is largest at the time of the first buckling followed by the second buckling. If it is designed to cause the first and second bucklings at a portion other than the extreme end of the openable member, a risk of rupture of the score line can be substantially reduced. On a thin wall can, the second buckling is apt to occur at a position at the opposite side of the first buckling position in reference to the center of the can lid but the second buckling should be caused to occur at the opposite side of the extreme end of the openable member in order to prevent rupture of the score line part.

Third and fourth buckling occur at positions of the opposite side of the first and second buckling positions in reference to the center of the can lid and the buckling should be avoided by all means at a position near the openable member, particularly, at a position near the extreme end of the openable member.

The following describes in detail the sequence of occurrence of the buckling. The top plate of the can lid is divided into four sector segments by a line which passes through the center of the can lid and the extreme end of the openable member (hereafter referred to as the "Y axis") and a line which orthogonally intersects the Y axis at the center of the can lid (hereafter referred to as the "X axis"). These four sector segments can be compared to a clock as if the extreme end side of the openable member is the 6 o'clock direction and the opposite side is the 12 o'clock direction. A sector segment from 12 o'clock to 3 o'clock is defined as the first quadrant, a sector segment from 9 o'clock to 12 o'clock is defined as the second quadrant, a sector segment from 6 o'clock to 9 o'clock is defined as the third quadrant, and a sector segment from 3 o'clock to 6 o'clock is defined as the third quadrant. The first buckling is caused to occur in the first or second quadrant and the second buckling is caused to occur in the remaining first or second quadrant.

The can lid is deformed primarily by two bucklings and is bulged outwardly as a result. The deformation due to any third and following bucklings is small. Accordingly, third and fourth bucklings are caused to occur in the third or fourth quadrant and, when the buckling occurs at a position near the openable member, particularly, its extreme end even though an amount of deformation is small, the score line is ruptured. Basic buckling does not occur more than four times.

Thus one of characteristics of the present invention is to cause the first and second bucklings to occur in the first and second quadrants and the third and fourth bucklings to occur at positions away from the extreme end of the openable member in the third and fourth quadrants.

For this, a buckling part with a larger buckling effect than for the third and fourth quadrants can be provided in the first and second quadrants of the can lid. When the buckling was actually arranged, it is known that there is a serious problem with respect to the position where the buckling part is arranged.

In other words, the parts where buckling occurs in the first and second bucklings are preferably provided within sector segments of 25–65 degrees from the Y axis of the first and second quadrants and, in addition, a concentric annular strip zone of approximately 12 mm from a position approximately as high as the top plate of the outer wall of the peripheral groove toward the center of the top plate.

If the buckling part is provided in this region, a risk of the second buckling occurring in the third or fourth quadrant is lessened.

It is clarified that, when the buckling regions are also provided in the third and fourth quadrants, the positions of third and fourth bucklings are controlled and therefore the score rupture preventing effect can be improved.

The buckling effect of the buckling part to be provided is preferably smaller than that of a buckling part provided in the first and second quadrants. Otherwise, there is a risk of the first and second bucklings occurring in the third and fourth quadrants.

Similarly, the position of the part that buckles in the third and fourth quadrants is preferably within the range of sector segment of 25–65 degrees from the Y axis and, in addition, a concentric annular strip zone of approximately 12 mm from a position approximately as high as the top plate of the outer wall of the peripheral groove toward the center of the top plate. If the buckling portion is provided outside this region, the score line of the openable member is apt to be ruptured by the third and fourth bucklings.

A groove provided as a buckling portion at the above described position on the top plate by coining or scoring exhibits a good buckling effect. This groove provides a large buckling effect and the buckling occurs at this part.

An embossed concavity can be arranged instead of the above groove. The buckling occurs around a concavity deformed by embossing as the starting point. In case of the embossed concavity, the buckling occurs at a position where the concavity is largely deformed, for example, at both tip ends of a semicircular concavity and the buckling starts from these tip ends if the tip ends are located at the above described positions on the can lid.

Moreover a dimple which is a convexity formed on the top plate also provides a large buckling effect. The buckling occurs at the periphery of the dimple and not at its peak.

A bead formed on the top plate forms an effective buckling part. An extreme end part of the bead serves as the buckling part where the buckling occurs. Therefore the extreme end part of the bead need be within the above described range of the can lid and, this requirement is satisfied, a shaped of bead is not limited and can be linear or arc-shaped.

If the extreme end of the bead is provided at the specified position near the peripheral groove, the bead can be linear-shaped or convexed toward the center of the can lid.

An embossed concavity and a bead can be formed across the first and second quadrants and across the third and fourth quadrants.

The bead can be a bead arranged across the first and fourth quadrants and a bead arranged across the second and third quadrants.

Beads can be separately arranged in each quadrant and not as a continued bead and, if an end of bead is within the range of 25–65 degrees from the center of the top plate from a line between the extreme end of the openable member and the center of the top plate of a 12 mm wide concentric annular part along the peripheral groove toward the center of the top plate from a position approximately as high as the top plate of the outer wall of the peripheral groove, the other end of the bead can be provided outside this range, for example, at the center side of the top plate.

Such bead is effective to control the position of the buckling if it is arranged also in the third and fourth quadrants.

In addition, a deformed internal wall which is formed by slanting an internal wall of the peripheral groove toward the center of the top plate is effective as a buckling part and its deformed part provides a large buckling effect owing to a structural discontinuity and a residual stress whereby the buckling occurs thereon.

A composite buckling part using plural types of buckling parts can be used as a buckling part. For example, coining and scoring or dimpling and scoring can be used in combination The buckling part can be formed by machining either from inside or outside the can lid.

As described above, the buckling part is arranged at four positions and the buckling is caused to occur there in sequence. In some cases of actual buckling, it is observed that the first and second bucklings occurred in the third and fourth quadrants. Then the buckling position was controlled by making the buckling effect of the buckling part in the first and second quadrants larger than that of the buckling part in the third and fourth quadrants. However, it was actually difficult to form such buckling parts which provide a large difference in the buckling effect even though such means as described above is used since handling and storage of can would be difficult, and therefore the first and second bucklings could not be eliminated from the third and fourth quadrants.

For this reason, the present invention specifies providing a reinforcing part along the overall periphery of the coupling part of the top plate and the peripheral groove and the neighborhood except for the buckling parts of the first and second quadrants and the neighboring areas in order to give an evident and effective difference to the buckling effect of the first and second quadrants and that of the third and fourth quadrants.

The reinforcing part is also provided for the buckling parts of the third and fourth quadrants and therefore the buckling effect of the buckling part in the third and fourth quadrant is extremely small as compared with that of the buckling part in the first and second quadrants. And the buckling parts of the first and second quadrants show a remarkable difference in the pressure strength from the reinforcing parts provided near the buckling parts and are apt to be buckled.

In the third and fourth quadrants, the reinforcing part can be arranged to be overlapped with the buckling part and can be provided with a distance without overlapping.

Though the buckling parts and their neighboring areas of the third and fourth quadrants are reinforced by the reinforcing parts, the buckling always occurs at the buckling parts since there is a definite difference of pressure strength between the buckling parts and the reinforcing parts of the neighboring areas even if both parts are reinforced. In other wards, even though both the reinforcing parts and the buckling parts are reinforced, bucklings definitely occur at the buckling parts since there is a large difference of pressure strength between the reinforced buckling parts and the reinforcing parts of the neighboring areas owing to the effect of the buckling parts.

Thus the buckling position could be completely controlled by combining the buckling part and the reinforcing part.

According to the present invention, an improper buckling part which adversely affects handling and storage of the cans need not be provided and a large practical effect in use can be obtained.

A suitable reinforcing part is a panel coining part formed by coining along the overall periphery of the coupling part of the top plate and the peripheral groove or the neighboring area except for the buckling part at the opposite side of the openable member and its neighboring area.

Further, the reinforcing effect can be increased by reducing the radius of curvature of the coupling part between the top plate and the peripheral groove and the reinforcing part with a reduced radius of curvature is also effective.

In addition, a reinforcing effect can be obtained by increasing the depth of the peripheral groove, except for the buckling parts and their neighboring area of the first and second quadrants. Though, strictly speaking, this reinforcing part is not provided on the coupling part of the top plate and the peripheral groove, this reinforcing part is included in the reinforcing part according to the present invention since it exhibits a similar effect on the buckling part provided along and near the peripheral groove.

The reinforcing part can be formed by post machining after the buckling part has been formed. Otherwise the buckling part can be formed after the reinforcing part has been previously formed.

EXAMPLES OF THE INVENTION

Preferred embodiments of the present invention are described in detail below.

FIG. 1 is an illustration of a can lid which is an embodiment of the present invention. In FIG. 1, a top plate 1 of a can lid has a peripheral groove 2. A tab 3 is coupled to the top plate 1 with a rivet 4 at the center of the can lid. An openable member 6 is surrounded by a score line 5. When the openable member 6 is pushed down by the extreme end of the tab 3, the score line 5 is ruptured and the openable member 6 is pushed down to form a tap opening. The axis line 25 passes through the extreme end of the openable member 6 and the center of the can lid. The line 25 is referred to as the Y axis. The axis line 26 orthogonally intersects the Y axis at the center of the top plate. The line 26 is referred to as the X axis. The X and Y axes are represented by virtual lines for the purpose of illustration and are not actual provisions on the can lid, and form the first quadrant 8, second quadrant 9, third quadrant 10 and fourth quadrant 11.

A groove is formed as the buckling part 7 by coining and is arranged nearby the peripheral groove 2 of the first quadrant 8 divided by the X axis and the Y axis. The groove or the buckling part 7 is located at a position 45 degrees away from the Y axis. The buckling parts 7 are also provided in the second quadrant 9, third quadrant 10 and fourth quadrant 11.

The reinforcing part 27 which is a panel coining part is provided nearby the coupling part of the top plate 1 and the peripheral groove 2. The reinforcing part 27 may be overlapped with the buckling parts 7. The reinforcing part 27 may be arranged without overlapped third and fourth quadrants 10 and 11. In this embodiment, the reinforcing part 27 is not formed on the buckling parts 7 and their neighboring areas of the first quadrant 8 and the second quadrant 9, and is formed on the buckling parts 7 of the third and fourth quadrants 10, 11.

The initial buckling occurs in the first or second quadrant 8, 9 where each of the buckling parts 7 has no reinforcing part 27. The initial buckling which induces a large amount of deformation due to buckling is caused to occur in the first or second quadrant at the opposite side of the openable member and therefore the risk of rupture of the opening score 5 is small.

The reinforcing part or panel coining part 27 is reinforced to provide large strength. Accordingly, the difference of strength between buckling part 7 and panel coining part 27 is large in the first and second quadrants 8, 9 and therefore the first and second bucklings are caused to occur in quadrants 8, 9.

On the other hand, in the third and fourth quadrants 10, 11, the buckling part 7 is reinforced by providing the panel coining part 27 and has a larger strength than that of the buckling parts of the first and second quadrants 8, 9. Accordingly, the first and second bucklings do not occur in the third and fourth quadrants 10, 11.

However, there is a definite difference of strength between the buckling part 7 and the panel coining reinforcing part 27 at the neighboring area even though the buckling part 7 is reinforced by panel coining part 27 and the third and fourth bucklings occur at the buckling parts of the third and fourth quadrants 10, 11.

The origin of the buckling part 7 may be provided nearby the coupling part of the top plate 1 and the peripheral groove 2 in the range of 25–65 degrees from the Y axis and therefore the buckling at the extreme end of the openable member 6 is avoided.

When a first buckling occurs, the amount of deformation is largest. When a second buckling occurs, the amount of deformation is second largest. These initial two bucklings occur in the quadrants at the opposite side of the place where the openable member 6 is located. Further, the third and following bucklings occur at the openable member side but the places of the bucklings are ones other than places nearby the openable member 6, whereby a risk of rupture of the score 5 is substantially lessened.

In FIG. 1, the buckling parts 7 are provided at a position 45 degrees away from the Y or X axis. If a buckling part 7 is not formed within the range of 25–65 degrees, the buckling part 7 may deteriorate the score rupture preventing the desired effect when buckling occurs, because there is a risk that the next following buckling position is likely to shift from the specified position due to the deformation by initial buckling.

The buckling part 7 can be formed as a scored groove or a convexed dimple which is formed by pushing up the top plate from the underside, instead of the coining groove.

Figure 2:
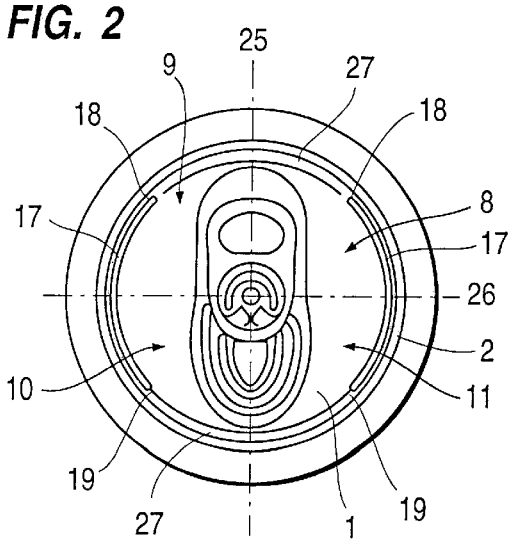
FIG. 2 is a plan view of a buckling part and a reinforcing part of a can lid according to the present invention.

FIG. 2 shows a can lid on which two beads 17 serving as the buckling part are provided across the first and fourth quadrants 8, 19 and across the second and third quadrants 9, 10. The extreme ends 18, 19 of these beads are arranged along the peripheral groove 2 in all four quadrants 8, 9, 10, 11. Though the pressure strength of the beads 17 themselves is large, the metal sheet at the boundary of the bead part and the non-bead part is pulled toward the beads 17 thereby causing the so-called "crimps" at the extreme ends 18 and 19 of the beads. Then a balance in the circumferential direction of the top plate 1 is lost and the buckling occurs at these points. The beads 17 are respectively provided 45 degrees away from the Y axis 25 and near the peripheral groove 2. A reinforcing part 27 is the panel coining part in this embodiment. This is an example of the reinforcing parts 27 of the third and fourth quadrants 10, 11 being overlapped with the buckling parts. The first and second bucklings occur in the first and second quadrants 8, 9 and the third and fourth bucklings occur in the third and fourth quadrants 10, 11.

The depth of the extreme ends 19 of the beads 17 can be made smaller than the extreme ends 18 of the beads 17 to provide a difference in buckling effect in the buckling parts.

Figure 3:
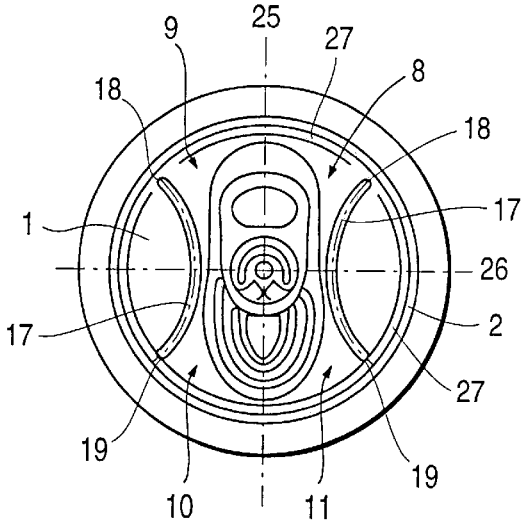
FIG. 3 is a plan view of a buckling part and a reinforcing part of a can lid according to the present invention.

FIG. 3 is an example where a bead 17 is not provided along the peripheral groove 2. Also in this case, the extreme ends 18, 19 of the beads 17 are respectively provided 45 degrees away from the Y axis 25 and near the peripheral groove 2. In this embodiment, the reinforcing part 27 is a panel coining part. The first and second bucklings occur in the first and second quadrants 8, 9 and subsequently the third and fourth bucklings occur in the third and fourth quadrants 10, 11.

Figure 4:
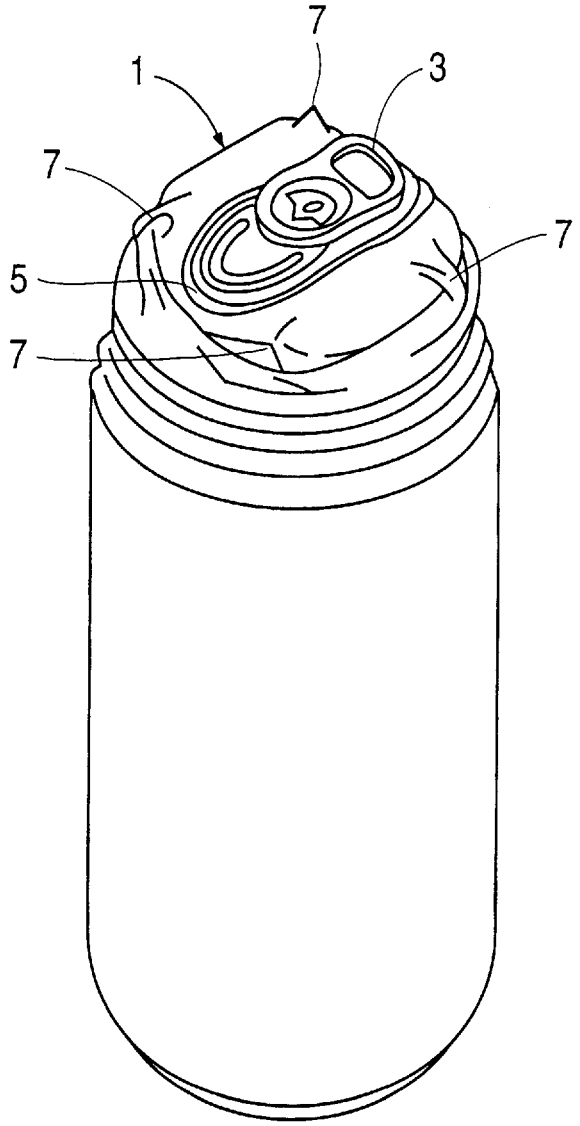
FIG. 4 is a perspective view showing a can using the can lid according to the present invention on which buckling has occurred.

FIG. 4 shows a can provided with a can lid shown in FIG. 1 on which buckling had the can lid bulged like a dome. Bucklings occurred at the buckling parts 7 and pushed up the top plate 1. In this example, bucklings have occurred four times. The first and second bucklings occurred at the specified positions of the first and second quadrants 8, 9, the third and fourth bucklings with small deformation occurred at the specified positions of the third and fourth quadrants 10, 11 thereby and the can was largely bulged out. However, the score 5 was not ruptured since the positions and sequence of the buckling occurred as designed.

Figure 5:
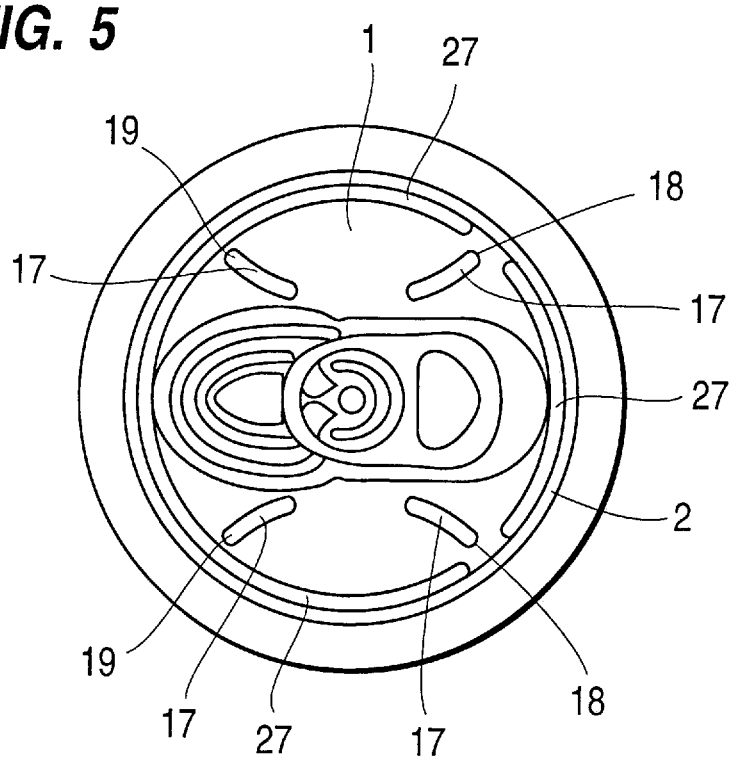
FIG. 5 is a plan view of a buckling part and a reinforcing part of a can lid according to the present invention.

FIG. 5 shows an example of arc-shaped beads wherein one end part of each of the beads 17 is provided at the specified position near the peripheral grooves and the other end is directed toward the center of the can lid and the beads are arranged on all sector segments of the can lid 1. The reinforcing parts 27 are the panel coining parts. In this embodiment, the reinforcing parts 27 of the first and second quadrants (not shown) are not overlapped with the buckling parts which are neighboring areas of one ends of beads 17, and the reinforcing parts 27 of the third and fourth quadrants (not shown) are overlapped with the buckling parts which are neighboring areas of the one ends 19 of the beads 17.

Figure 6:
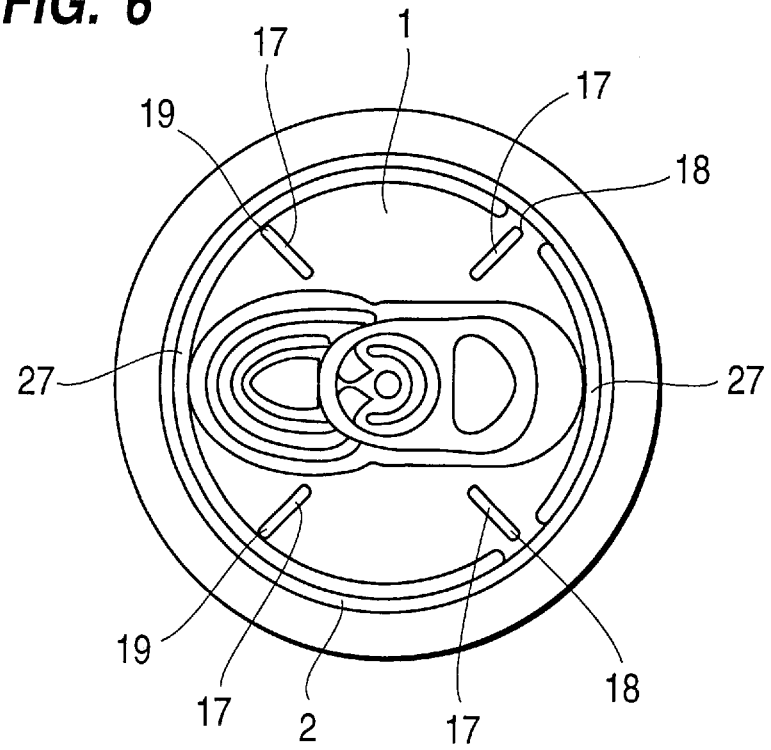
FIG. 6 is a plan view of a buckling part and a reinforcing part of a can lid according to the present invention.

FIG. 6 shows an example of linear beads 17. On these can lids, buckling occurs in the third and fourth quadrants, following the first and second quadrants.

Figure 7:
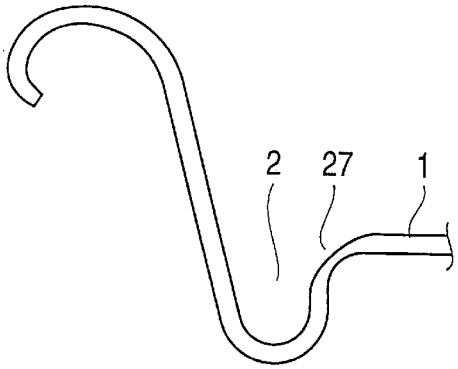
FIG. 7 is a partial sectional view of a panel coining given from the surface side of the buckling part and the reinforcing part of the can lid according to the present invention.

FIG. 7 shows a panel coining 27 which is provided as a reinforcing part by coining at the coupling part of the top plate 1 and the peripheral groove 2 to increase the pressure strength of the can as a whole. In this example, coining is given from the surface. The panel coining part 27 is provided along the overall periphery except for nearby the buckling parts of the first and second quadrants. The pressure strength reinforcing effect of the panel coining is large.

Though the panel coining is provided at the buckling parts of the third and fourth quadrants, there is a definite difference in strength between the coining reinforcing part and the nearby reinforcing part and the buckling always occurs at the buckling part owing to the buckling effect of the buckling part.

Figure 8:
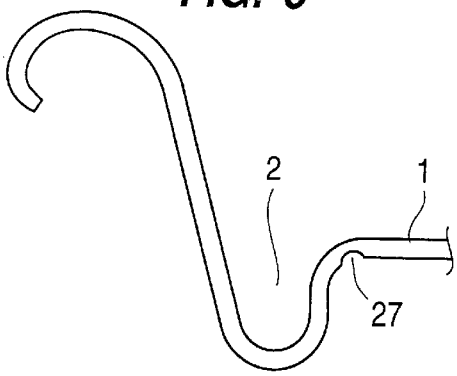
FIG. 8 is a partial sectional view of a panel coining given from the rear side of the buckling part and the reinforcing part of the can lid according to the present invention.

FIG. 8 shows an example of a panel coining 27 which is formed by coining the coupling part of the top plate 1 and the peripheral groove 2 from the underside. Arrangement of the panel coining is the same as shown in FIG. 7.

Figure 9:
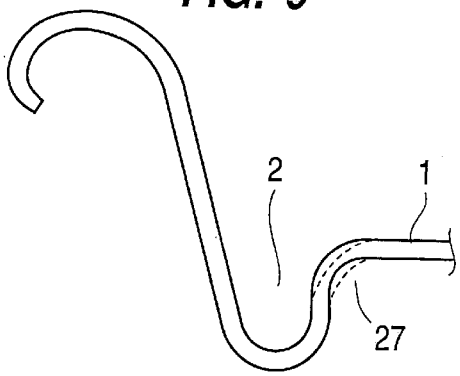
FIG. 9 is a partial sectional view of a reinforcing part when the radius of curvature of the can lid according to the present invention is reduced.

FIG. 9 shows an example of a reinforcing part formed by reducing the radius of curvature of the coupling part of the top plate 1 and the peripheral groove 2. The radius of curvature of the reinforcing part shown with a solid line is smaller than that of the coupling part near the buckling part at the opposite side of the openable member shown with a broken line.

Figure 10:
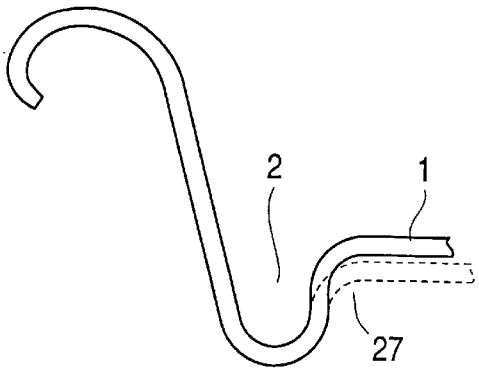
FIG. 10 is a partial sectional view of a reinforcing part when the depth of the groove according to the present invention is increased.

FIG. 10 shows an example of a reinforcing part formed by increasing the depth of the peripheral groove 2. The depth of the peripheral groove 2 shown with a solid line is larger than that of the groove 2 shown with a broken line near the buckling part at the opposite side of the openable member.

The results of comparison tests are shown below.

COMPARISON TESTS

Example 1

An aluminum can was used to which a can lid shown in FIG. 1 which is molded with 0.25 mm thick aluminum sheet and is double seamed.

Example 2

Similarly conducted as in Example 1 except that a can lid shown in FIG. 2 was used.

Comparison Example 1

Similarly conducted as in Example 1 except that a can lid which is not provided with the buckling part was used.

Comparison Example 2

The buckling part as a coining groove was provided only in the first and second quadrants.

Each of 100 cans was filled with carbon dioxide containing water of 4 G.V. The buckling was caused while the cans were kept in an isothermal container with the liquid temperature of 80° C. and the number of cans from which carbon dioxide water splashed out was counted. The test results are shown in Table 1.

TABLE 1

| | Number of cans with buckling occurred | Number of cans from which the contents splashed out |
|---|---|---|
| Example 1 | 100 | 0 |
| Example 2 | 100 | 0 |
| Comparison example 1 | 100 | 100 |
| Comparison example 2 | 100 | 16 |

As shown in Table 1, the can lids of Examples 1 and 2 according to the present invention have exhibited excellent results with less risks of rupture of the score lines due to buckling.

What is claimed is:

1. An easily openable can lid comprising:

a top plate and a peripheral groove provided proximate a periphery of said top plate, a tab fastened to said top plate at an approximate center of the top plate, a discontinuous score line, that is, a score line having a starting point and an ending point spaced from the starting point, wherein the starting point and the ending point are located near to said center;

a push-open openable member having a tip end surrounded by said score line, the tip end extending towards the periphery of the top plate, four buckling sections respectively provided in four sector segments in said top plate near to said peripheral groove in a range of 25 to 65 degrees, the four sector segments being defined by a first straight line drawn between the tip end of said openable member and passing through the center of said top plate and a second straight line which passes through the center of the top plate and orthogonally intersects the said first straight line at said center, said first and second lines dividing said top plate into said four sector segments, and a reinforcing part provided between the center of the top plate and said peripheral groove, there being one buckling section in each of said four sector segments, wherein, to provide a difference of strength between the two buckling sections nearest the openable member and the two buckling sections at an opposite side of the openable member, each of the two buckling sections in the two sector segments at the opposite side of said openable member buckles before either of the two buckling sections in the two sector segments located nearest said openable member buckle.

2. An easily openable can lid in accordance with claim 1, wherein said buckling sections are a deformed internal wall part which is formed by deforming an internal wall of said peripheral groove toward the center of the top plate.

3. An easily openable can lid in accordance with claim 1, wherein said buckling sections are located at an extreme end of a bead formed on the top plate by beading.

4. An easily openable can lid in accordance with claim 3 wherein said buckling sections are an extreme end of a linear or arc-shaped bead.

5. An easily openable can lid in accordance with claim 3, wherein said buckling sections are an extreme end of an arc-shaped bead provided along nearby the peripheral groove of the top plate.

6. An easily openable can lid in accordance with claim 3, wherein said buckling sections are located at an extreme end of a bead provided across each of first and second two sector segments.

7. An easily openable can lid in accordance with claim 1, wherein said buckling sections are provided by coining, scoring, embossing, dimpling, deforming of the internal wall, or beading.

8. An easily openable can lid in accordance with claim 1, wherein said buckling sections are composite buckling sections formed by doubly applying two or more processes of coining, scoring, embossing, dimpling, deforming of the internal wall, and beading.

9. An easily openable can lid in accordance with claim 1, wherein said reinforcing part is overlapped with the buckling section at the openable member side.

10. An easily openable can lid in accordance with claim 1, wherein said reinforcing part is not overlapped with the buckling section at the openable member side.

11. An easily openable can lid according to claim 1, further comprising a metal beverage container to which the can lid is fitted.

12. A can lid comprising:

a top plate having first, second, third, and fourth sectors defined by first and second orthogonally intersecting lines;

an openable member formed in the top plate and having a tip end extending toward a periphery of the top plate;

a tab, fastened to the top plate, for opening the openable member; and first and second buckling sections respectively provided in the first and second sectors in a range of 25 to 65 degrees;

wherein the first and second buckling sections buckle before any part of the top plate in the third and fourth sectors.

13. A can lid as claimed in claim 12, wherein the second line passes through the tip end of the openable member.

14. The can lid as claimed in claim 13, wherein the first and second lines intersect at a center of the top plate.

15. A can lid as claimed in claim 12, wherein the top plate includes a peripheral groove, a reinforcement being provided between the tip end and the peripheral groove.

16. A can lid as claimed in claim 12, further comprising a score line having a starting point and an ending point spaced from the starting point, the tip end being defined by a portion of the score line.

17. A can lid as claimed in claim 16, wherein a portion of the top plate between the starting point and the ending point serves as a hinge when the openable member is opened.

18. A can lid as claimed in claim 16, wherein a third buckling section is provided in the third sector, and wherein the third buckling section buckles before the score line ruptures.

19. A can lid as claimed in claim 18, wherein a fourth buckling section is provided in the fourth sector, and wherein the fourth buckling section buckles before the score line ruptures.

20. A can lid as claimed in claim 12, wherein the openable member is a push-open openable member.

21. A method of controlling the buckling of a can lid, comprising:

organizing a can lid with four sectors defined by first and second orthogonally intersecting lines;

forming a discontinuous score line in the can lid that extends across two of the four sectors;

forming buckling portions in the can lid so that the two sectors with the discontinuous score line extending across them buckle in a range of 25 to 65 degrees after each of the other two sectors buckle.

22. The method of claim 21, wherein the step of forming the discontinuous score line further comprises forming an openable member in the can lid and surrounding a tip end of the openable member with the discontinuous score line.

23. The method of claim 21, wherein the step of forming the buckling portions further comprises forming separate buckling portions in each of the other two sectors.

24. An easily openable can lid comprising:

a top plate and a peripheral groove provided proximate a periphery of said top plate, a tab fastened to said top plate at an approximate center of the top plate, a score line having a starting and an ending point located near to said center;

an openable member having a tip end surrounded by said score line, the tip end extending towards the periphery of the top plate, four buckling sections respectively provided in four sector segments in said top plate near to said peripheral groove in a range of 25 to 65 degrees, the four sector segments being defined by a first straight line drawn between the tip end of said openable member and passing through the center of said top plate and a second straight line which passes through the center of the top plate and orthogonally intersects the said first straight line at said center, said first and second lines dividing said top plate into said four sector segments, and a reinforcing part provided between the center of the top plate and said peripheral groove, there being one buckling section in each of said four sector segments, wherein, to provide a difference of strength between the two buckling sections nearest the openable member and the two buckling sections at an opposite side of the openable member, each of the two buckling sections in the two sector segments at the opposite side of said openable member buckles before either of the two buckling sections in the two sector segments located nearest said openable member buckles;

wherein said buckling sections are coined or scored concavities on said top plate, concave with respect to an adjacent surface of said top plate.

25. An easily openable can lid comprising:

a top plate and a peripheral groove provided proximate a periphery of said top plate, a tab fastened to said top plate at an approximate center of the top plate, a score line having a starting and an ending point located near to said center;

an openable member having a tip end surrounded by said score line, the tip end extending towards the periphery of the top plate, four buckling sections respectively provided in four sector segments in said top plate near to said peripheral groove in a range of 25 to 65 degrees, the four sector segments being defined by a first straight line drawn between the tip end of said openable member and passing through the center of said top plate and a second straight line which passes through the center of the top plate and orthogonally intersects the said first straight line at said center, said first and second lines dividing said top plate into said four sector segments, and a reinforcing part provided between the center of the top plate and said peripheral groove, there being one buckling section in each of said four sector segments, wherein, to provide a difference of strength between the two buckling sections nearest the openable member and the two buckling sections at an opposite side of the openable member, each of the two buckling sections in the two sector segments at the opposite side of said openable member buckles before either of the two buckling sections in the two sector segments located nearest said openable member buckles;

wherein said buckling sections are embossed concavities on said top plate, concave with respect to an adjacent surface of said top plate.

26. An easily openable can lid comprising:

a top plate and a peripheral groove provided proximate a periphery of said top plate, a tab fastened to said top plate at an approximate center of the top plate, a score line having a starting and an ending point located near to said center;

an openable member having a tip end surrounded by said score line, the tip end extending towards the periphery of the top plate, four buckling sections respectively provided in four sector segments in said top plate near to said peripheral groove in a range of 25 to 65 degrees, the four sector segments being defined by a first straight line drawn between the tip end of said openable member and passing through the center of said top plate and a second straight line which passes through the center of the top plate and orthogonally intersects the said first straight line at said center, said first and second lines dividing said top plate into said four sector segments, and a reinforcing part provided between the center of the top plate and said peripheral groove, there being one buckling section in each of said four sector segments, wherein, to provide a difference of strength between the two buckling sections nearest the openable member and the two buckling sections at an opposite side of the openable member, each of the two buckling sections in the two sector segments at the opposite side of said openable member buckles before either of the two buckling sections in the two sector segments located nearest said openable member buckles;

wherein said buckling sections are dimple formed on the top plate by pushing up said top plate.

27. An easily openable can lid comprising:

a top plate and a peripheral groove provided proximate a periphery of said top plate, a tab fastened to said top plate at an approximate center of the top plate, a score line having a starting and an ending point located near to said center;

an openable member having a tip end surrounded by said score line, the tip end extending towards the periphery of the top plate, four buckling sections respectively provided in four sector segments in said top plate near to said peripheral groove in a range of 25 to 65 degrees, the four sector segments being defined by a first straight line drawn between the tip end of said openable member and passing through the center of said top plate and a second straight line which passes through the center of the top plate and orthogonally intersects the said first straight line at said center, said first and second lines dividing said top plate into said four sector segments, and a reinforcing part provided between the center of the top plate and said peripheral groove, there being one buckling section in each of said four sector segments, wherein, to provide a difference of strength between the two buckling sections nearest the openable member and the two buckling sections at an opposite side of the openable member, each of the two buckling sections in the two sector segments at the opposite side of said openable member buckles before either of the two buckling sections in the two sector segments located nearest said openable member buckles;

wherein said buckling sections are located at an extreme end of a bead formed on the top plate by beading;

wherein said buckling sections are defined by areas between (a) extreme ends of a concentric area along the peripheral groove of approximately 12 mm in width toward the center of the top plate from a position, on a wall of the peripheral groove, approximately as high as the center of the top plate and (b) an extreme end of each of four linear or arc-shaped beads located toward the center of the top plate.

28. An easily openable can lid comprising:

a top plate and a peripheral groove provided proximate a periphery of said top plate, a tab fastened to said top plate at an approximate center of the top plate, a score line having a starting and an ending point located near to said center;

an openable member having a tip end surrounded by said score line, the tip end extending towards the periphery of the top plate, four buckling sections respectively provided in four sector segments in said top plate near to said peripheral groove in a range of 25 to 65 degrees, the four sector segments being defined by a first straight line drawn between the tip end of said openable member and passing through the center of said top plate and a second straight line which passes through the center of the top plate and orthogonally intersects the said first straight line at said center, said first and second lines dividing said top plate into said four sector segments, and a reinforcing part provided between the center of the top plate and said peripheral groove, there being one buckling section in each of said four sector segments, wherein, to provide a difference of strength between the two buckling sections nearest the openable member and the two buckling sections at an opposite side of the openable member, each of the two buckling sections in the two sector segments at the opposite side of said openable member buckles before either of the two buckling sections in the two sector segments located nearest said openable member buckles;

wherein said buckling sections are located at an extreme end of a bead formed on the top plate by beading;

wherein said buckling sections are located at an extreme end of an arc-shaped bead, said arc-shaped bead being arranged across each of two sector segments at the opposite side of the openable member side and said arc-shaped bead being convex toward the center of the can lid.

29. An easily openable can lid comprising:

a top plate and a peripheral groove provided proximate a periphery of said top plate, a tab fastened to said top plate at an approximate center of the top plate, a score line having a starting and an ending point located near to said center;

an openable member having a tip end surrounded by said score line, the tip end extending towards the periphery of the top plate, four buckling sections respectively provided in four sector segments in said top plate near to said peripheral groove in a range of 25 to 65 degrees, the four sector segments being defined by a first straight line drawn between the tip end of said openable member and passing through the center of said top plate and a second straight line which passes through the center of the top plate and orthogonally intersects the said first straight line at said center, said first and second lines dividing said top plate into said four sector segments, and a reinforcing part provided between the center of the top plate and said peripheral groove, there being one buckling section in each of said four sector segments, wherein, to provide a difference of strength between the two buckling sections nearest the openable member and the two buckling sections at an opposite side of the openable member, each of the two buckling sections in the two sector segments at the opposite side of said openable member buckles before either of the two buckling sections in the two sector segments located nearest said openable member buckles;

wherein said reinforcing part is a panel coining part formed by coining the overall periphery of a coupling part between the top plate and the peripheral groove except for the buckling section at the opposite side of the openable member.

30. An easily openable can lid comprising:

a top plate and a peripheral groove provided proximate a periphery of said top plate, a tab fastened to said top plate at an approximate center of the top plate, a score line having a starting and an ending point located near to said center;

an openable member having a tip end surrounded by said score line, the tip end extending towards the periphery of the top plate, four buckling sections respectively provided in four sector segments in said top plate near to said peripheral groove in a range of 25 to 65 degrees, the four sector segments being defined by a first straight line drawn between the tip end of said openable member and passing through the center of said top plate and a second straight line which passes through the center of the top plate and orthogonally intersects the said first straight line at said center, said first and second lines dividing said top plate into said four sector segments, and a reinforcing part provided between the center of the top plate and said peripheral groove, there being one buckling section in each of said four sector segments, wherein, to provide a difference of strength between the two buckling sections nearest the openable member and the two buckling sections at an opposite side of the openable member, each of the two buckling sections in the two sector segments at the opposite side of said openable member buckles before either of the two buckling sections in the two sector segments located nearest said openable member buckles;

wherein said reinforcing part is a deformed coupling part with a smaller radius of curvature of a coupling part between the top plate and the peripheral groove along the overall periphery except for the buckling section at the opposite side of the openable member.

31. An easily openable can lid comprising:

a top plate and a peripheral groove provided proximate a periphery of said top plate, a tab fastened to said top plate at an approximate center of the top plate, a score line having a starting and an ending point located near to said center;

an openable member having a tip end surrounded by said score line, the tip end extending towards the periphery of the top plate, four buckling sections respectively provided in four sector segments in said top plate near to said peripheral groove in a range of 25 to 65 degrees, the four sector segments being defined by a first straight line drawn between the tip end of said openable member and passing through the center of said top plate and a second straight line which passes through the center of the top plate and orthogonally intersects the said first straight line at said center, said first and second lines dividing said top plate into said four sector segments, and a reinforcing part, there being one buckling section in each of said four sector segments, wherein, to provide a difference of strength between the two buckling sections nearest the openable member and the two buckling sections at an opposite side of the openable member, each of the two buckling sections in the two sector segments at the opposite side of said openable member buckles before either of the two buckling sections in the two sector segments located nearest said openable member buckles;

wherein said reinforcing part comprises a part of the peripheral groove having a death, along the overall periphery except near the buckling section at the opposite side of the openable member, deeper than the depth of the peripheral groove near the buckling section at the opposite side of the openable member.

* * * * *